US006808000B1

(12) United States Patent
Peterson

(10) Patent No.: US 6,808,000 B1
(45) Date of Patent: Oct. 26, 2004

(54) VERTICALLY MOVABLE SECURITY PARTITION

(75) Inventor: Miles E. Peterson, Ottawa (CA)

(73) Assignee: Railtech Ltd., Baie d' Urfs (CA)

( * ) Notice: Subject to any disclaimer, the term of this patent is extended or adjusted under 35 U.S.C. 154(b) by 0 days.

(21) Appl. No.: 10/430,528

(22) Filed: May 6, 2003

(51) Int. Cl.[7] ..... E06B 9/06
(52) U.S. Cl. ..... 160/84.11; 160/138; 160/213
(58) Field of Search ..... 160/84.09, 84.11, 160/138, 137, 136, 150, 188, 213

(56) References Cited

U.S. PATENT DOCUMENTS

| | | | | | |
|---|---|---|---|---|---|
| 231,817 | A | * | 8/1880 | Kerr | 160/84.09 |
| 702,146 | A | * | 6/1902 | McCloud | 160/147 |
| 1,892,340 | A | * | 12/1932 | Guth | 160/147 |
| 1,965,262 | A | * | 7/1934 | Seregi | 160/149 |
| 2,237,141 | A | * | 4/1941 | Gale | 160/125 |
| 3,378,059 | A | * | 4/1968 | Young | 160/165 |
| 5,062,464 | A | | 11/1991 | Peterson | 160/193 |
| 6,267,169 | B1 | * | 7/2001 | McDonald | 160/193 |

FOREIGN PATENT DOCUMENTS

| | | |
|---|---|---|
| CA | 2064348 | 5/1994 |

* cited by examiner

*Primary Examiner*—David Purol
(74) *Attorney, Agent, or Firm*—Conley Rose, P.C.

(57) ABSTRACT

A mechanical curtain, upwardly movable into open position and downwardly movable into closed position, the curtain comprising: a) a plurality of similarly constructed trains of elongated members, the members of each train arranged to form a single pantograph forming longitudinally aligned rows of diamonds, the trains spaced laterally to form a curtain plane and oriented so that the diamonds of the pantographs operate in a plane at a 90° angle to that curtain plane, b) a plurality of bars secured in parallel spaced fashion to corresponding members in adjacent trains, perpendicular thereto, and, c) one or more cables to raise and lower the trains at a similar rate the pantographs being contracted when the curtain is in open position and the pantographs being elongated when the curtain is in closed position.

16 Claims, 9 Drawing Sheets

VERTICALLY MOVABLE SECURITY PARTITION

FIELD OF THE INVENTION

The present invention relates to mechanical curtains and more particularly to vertically movable partitions for use within buildings, example to cordon off areas, as required, to prevent public access or for crowd control.

BACKGROUND OF THE INVENTION

Security partitions in the form of security gates are well known and may take the form of horizontally sliding bar systems, for example to close off open fronts of shops in shopping centers or to be moved across entrance ways to shops on streets. These types of movable security gates usually require storage space beside the area being protected, to accommodate the gate components when not in use. Conversely, existing "roll-up" security gates are stored in ceiling space when not in use. This type of gate is severely limited in width and height as the roller can only be supported at its ends and cannot deflect under the load of the gate.

U.S. Pat. No. 5,062,464 of Miles Peterson, issued Nov. 5, 1991 describes and illustrates a wall partition, which uses a pantograph type of construction to provide a rigid wall section, which is vertically collapsible and movable to a storage position. Movable wall partition systems have similar problems of storage and structural support requirements and the Peterson vertically movable wall partition avoids those problems by providing ceiling storage for the wall partitions and a single permanent location for all of the panels so that the loads imposed on the building support structure do not vary because of lateral movement of the panels. Further, this design of the wall system allows the partition to be of any width or height as it is lifted and supported at multiple points across its width. This is made possible as the partition is folded up rather than rolled up.

The pantograph structure as suggested by the Peterson construction is similar to that for instance found in baby gates in which a series of elongated members are pivotally linked together in spaced fashion to provide a series of similar diamonds along the length of the gate. In a single (as opposed to multiple) pantograph construction, a pair of members of similar size are pivotally linked at their midpoints. One pair of their ends are pivotally linked to the ends of a further corresponding pair of members of similar length similarly pivoted at their midpoint, and so on. The midpoints of the members are longitudinally aligned and form opposed longitudinal apexes of diamond shapes; the other opposed corners of these diamonds are formed by the pivotally secured ends of adjacent pairs of intersecting members, and are the lateral apexes. The pantograph structure expands and contracts longitudinally. The pantograph structure in such applications is useful because it causes forces applied longitudinally, in the direction of expansion and contraction of the pantograph, to be transmitted evenly throughout all of the members of the pantograph structure. As well, all of the apexes of the diamonds formed by the points of intersection of the members, as the structure is contracted, will arrive at their final, fully contracted position at the same time, meaning that the longitudinal apexes of the diamonds at one end of the pantograph structure, which are moving towards the other end during contraction, will move at a much greater speed than the apexes of the diamonds at the other end.

It is an object of the present invention to provide a mechanical curtain, which is based on these pantograph principles.

SUMMARY OF THE INVENTION

In accordance with the present invention there is provided a mechanical curtain, upwardly movable into open position and downwardly movable into closed position. The curtain comprises a plurality of similarly constructed trains of elongated members, the members of each train arranged to form a single pantograph forming longitudinally aligned rows of diamonds. The trains are spaced laterally to lie within a curtain plane and are oriented so that the pantographs operate in a plane at a 90° angle to that curtain plane. A plurality of bars are secured in parallel spaced fashion to corresponding members of adjacent trains, perpendicular thereto. Means are provided to raise and lower the trains at a similar rate, the pantographs being contracted when the curtain is in open position and being elongated when the curtain is in closed position.

In one embodiment of the present invention, particularly applicable for use as a security gate, the curtain is further provided with locking means to secure the curtain in closed position against unwanted opening.

The curtain according to the present invention has many advantages. When used as a security gate, because its components move vertically rather than horizontally, storage space is not required to the side of the entrance way or other area within which the curtain operates, since the curtain folds and stores above the passageway or area in question. Furthermore, because the curtain does not move horizontally, the loads imposed on the support structure are constant. Also, the height and width restrictions present with conventional roll-up security gates are avoided since the curtain of the present invention may be lifted and supported at multiple points across its width.

BRIEF DESCRIPTION OF THE DRAWINGS

These and other advantages of the invention will become apparent upon reading the following detailed description and upon referring to the drawings in which.

Figure 1:
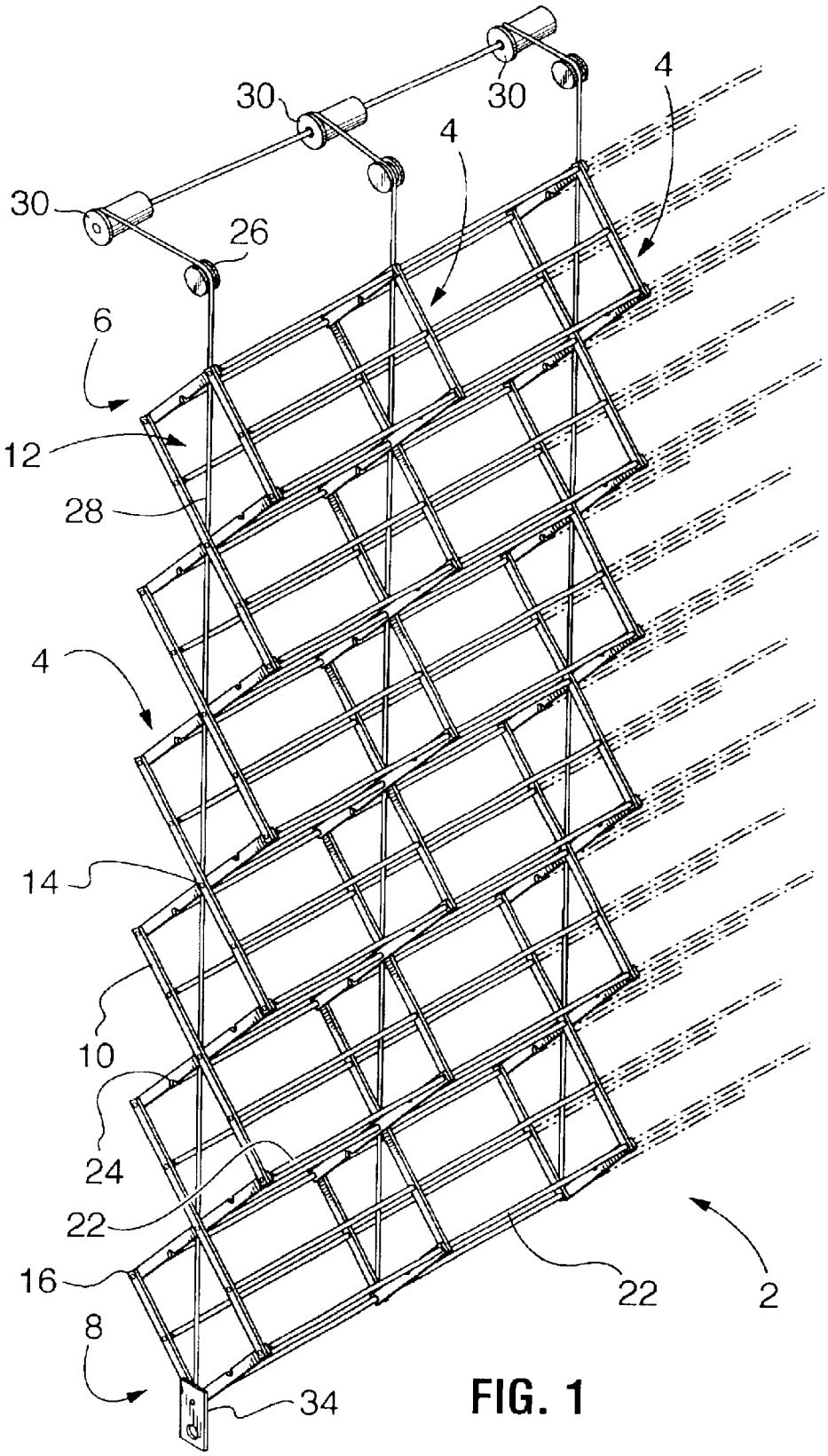
FIG. 1 is a perspective partial view of a mechanical curtain, adapted to be used as a security gate, in a partially closed position.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Figure 2A:
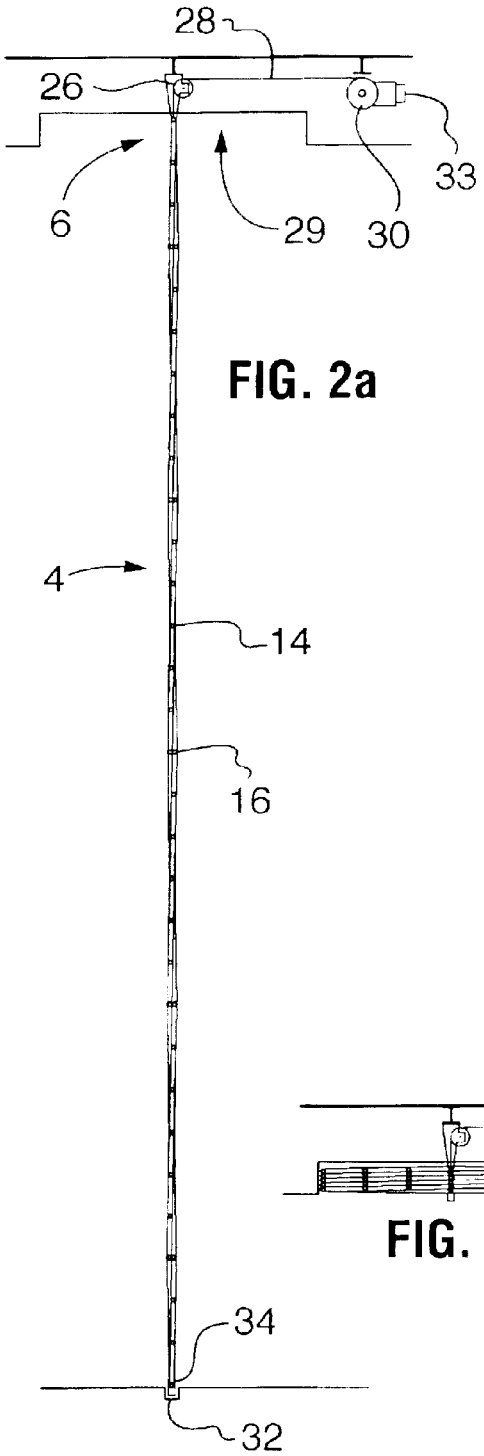
FIGS. 2*a*, 2*b* and 2*c* are side elevation views of an end train of the curtain of FIG. 1, showing that train respectively in expanded (or closed) position, partially closed position and fully contracted (or open) position.
Figure 2B:
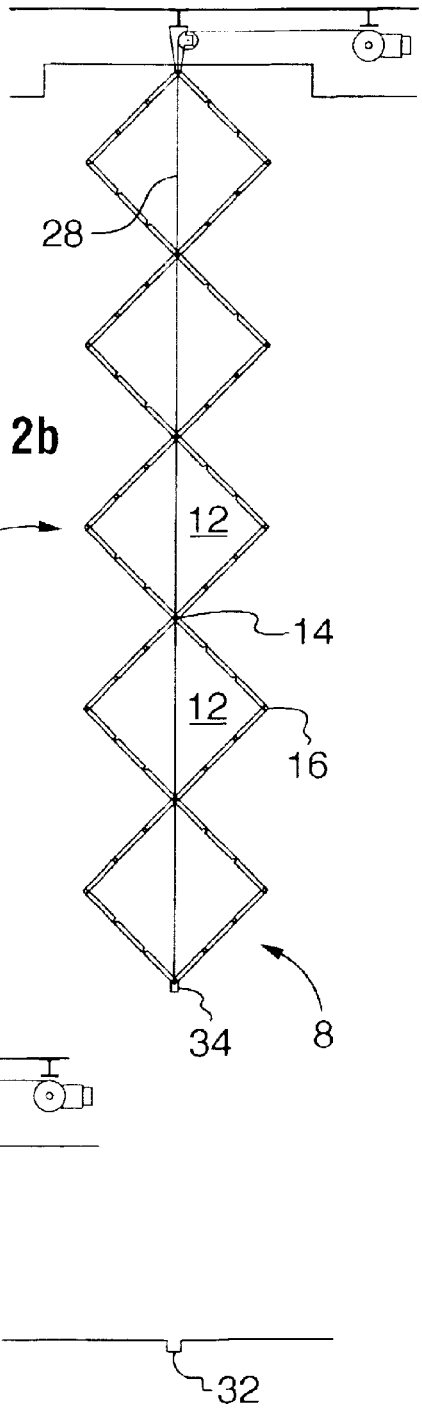
Figure 2C:
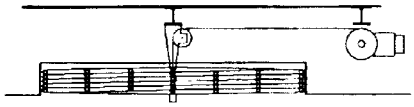

Turning to FIG. 1 there is illustrated a mechanical curtain 2 in accordance with the present invention, in partially lowered (closed) position. The curtain as illustrated is particularly useful as a security gate. Curtain 2 is formed from a plurality of similar pantograph trains 4, longitudinally laterally spaced to form a plane of the curtain. Each train has an upper end 6 and a lower end 8, and is composed of elongated members 10, which form, in each train 4, aligned rows of diamonds 12. Other than for the last diamond 12 in each train 4, (at upper end 6 and lower end 8), similar pairs of elongated members 10 intersect and are secured pivotally together centrally between their ends as illustrated, to form vertically disposed longitudinal apexes 14 of diamonds 12. Corresponding ends of these pairs of intersecting members 10 pivotally connect to the ends of other pairs of similar intersecting members 10 to form at these ends laterally disposed apexes 16. Thus, as can be seen in FIG. 2*a*, when trains 4 are elongated in the longitudinal direction, the longitudinal apexes 14 of each diamond 12 are more separated and the laterally disposed apexes 14 are drawn together, while, as can be seen in FIG. 2*c*, when the trains are contracted, the longitudinal apexes 14 of each diamond 12 are drawn together and the laterally disposed apexes 16 are more separated.

Cooperating pairs of intersecting elongated members are preferably laterally offset on opposite sides of the apexes 14 and 16 by central spacers 18 (FIG. 4) so that they do not obstruct each other during opening and closing operation of the curtain. A longitudinally oriented aperture 20, of the longitudinal apexes 14, the function of which will be described subsequently, may be provided in each spacer 18.

Each pantograph train 4 operates with its diamonds 12 being in a plane, which is at a 90° angle to the curtain plane, as can be seen in FIG. 1.

Extending between adjacent trains 4 and secured to corresponding members 10 of adjacent trains are a plurality of spaced bars 22. Notches 24 (FIG. 3) are provided along interior edges of members 10 in each diamond, to receive portions of corresponding bars in opposite members 10 of the diamonds, when the trains are in their most elongated position.

Figure 3:
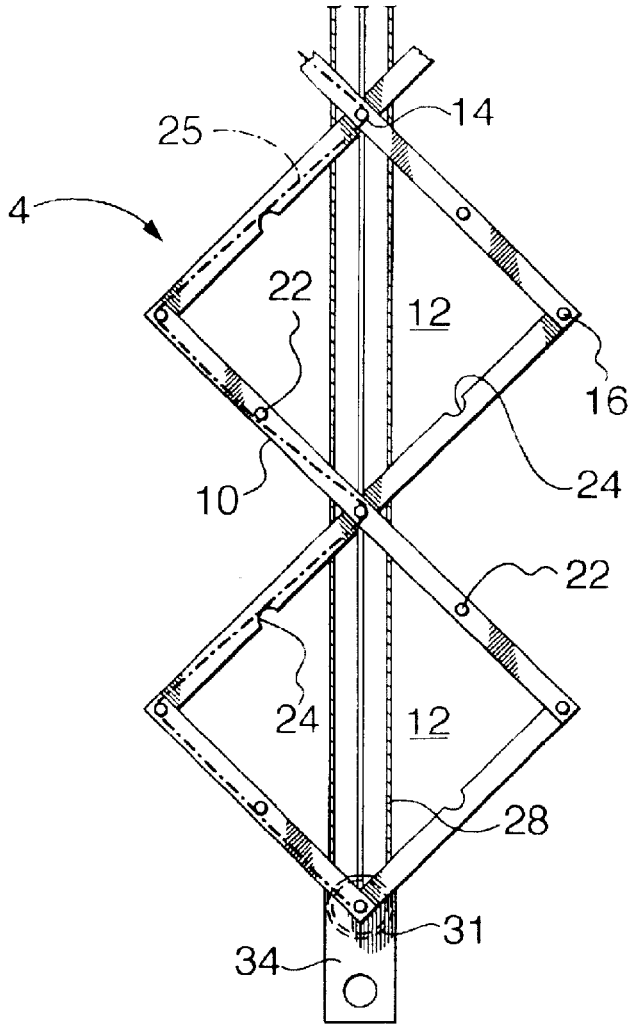
FIG. 3 is an enlarged side elevation view of a portion of a train of the curtain of FIG. 1, in partially closed position as shown in FIG. 2*b*, showing in more detail certain of the components of the train.

As can be seen in FIG. 3, as an option, a fabric 25 (chain-line) may be secured about bars 22 over a portion or all of the intended surface area of the curtain, the fabric for example being interwoven through the bars over one side of the diamonds 12 of the trains, as illustrated.

As can be seen in FIG. 1, to move the curtain 2 longitudinally between upper, open position and lower, closed position, a drums 30 are provided with cables 28, one end of each of which is wrapped around its corresponding drum. Each cable passes over a corresponding sheave or pulley 26, and its other end may be operatively connected to a lower end 8 of its corresponding train 4, as illustrated, or to a bar 22 extending between adjacent trains 4 at their lower end 8. For proper balance, the cables may extend vertically downwardly from sheaves 26 through aperture 20 in spacers of the longitudinal apexes 14 and be secured to the lower. longitudinal apex 14 of its corresponding train 4.

Figure 4:
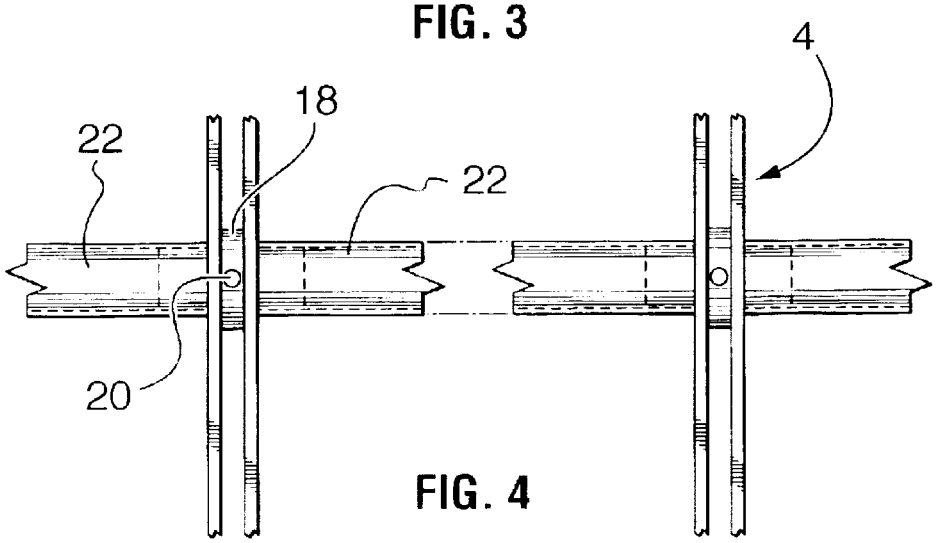
FIG. 4 is a plan view from the top of a portion of the curtain of FIG. 1.

As can be seen in FIG. 4, bars 22 may be mounted so as to extend outwardly towards adjacent trains at longitudinal apexes 14. Alternatively, for example, the cables 28 may be looped around a pulley 31 (phantom, FIG. 3) with the free end of the cable appropriately connected above the curtain, to provide a double purchase arrangement for raising and lowering the curtain. An appropriate drive means 33 (FIGS. 2*a*, 2*b*, 2*c*) for drums 30 is provided so that by unwinding and winding each cable 28 in a similar manner with respect to drums 30, the pantographs are respectively elongated to close or contracted to open the curtain.

When the curtain is designed as a security gate, an appropriate conventional lock mechanism 32 (FIGS. 2*a* and 2*b*) may be provided, for example secured on or in an appropriate portion of the floor below the curtain, to cooperate with lock mechanism 34 secured, to lower end 8 of train 4.

For purpose of weight balance of the curtain, it is desired that similar numbers of bars 22 be secured to elongated members 10, preferably in an alternating fashion, on each side of the centre line of the trains (i.e. on each side of the longitudinal axis of the trains running through the longitudinal apexes).

Figure 5A:
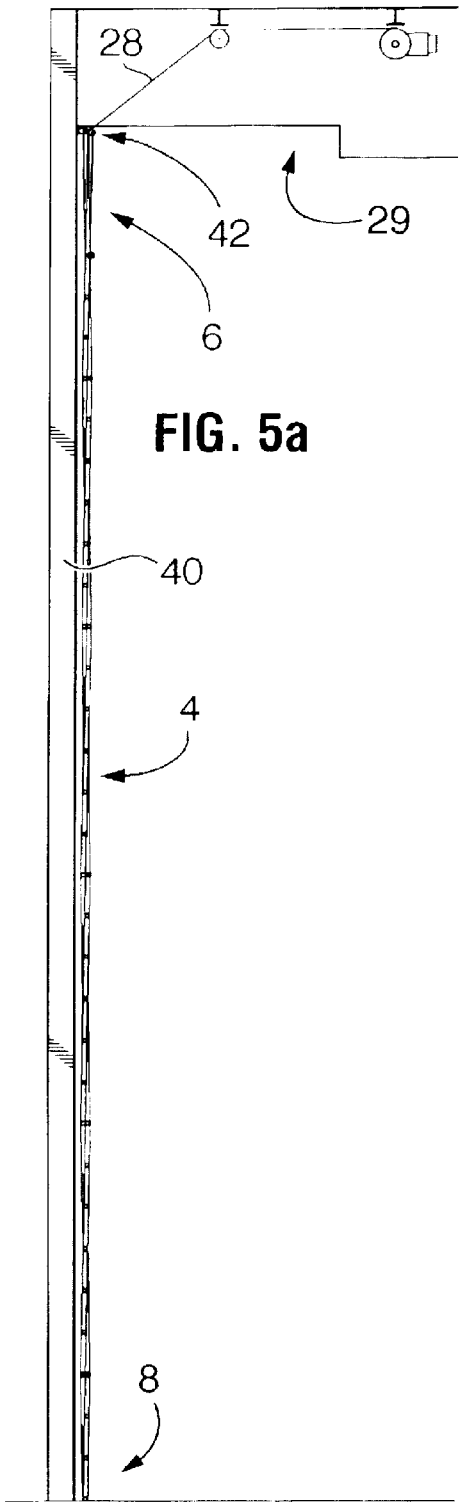
FIGS. 5*a*, 5*b* and 5*c* are side elevation views of an end train of an alternative embodiment of the curtain according to the present invention, showing that train respectively in expanded, partially closed and fully contracted positions.
Figure 5B:
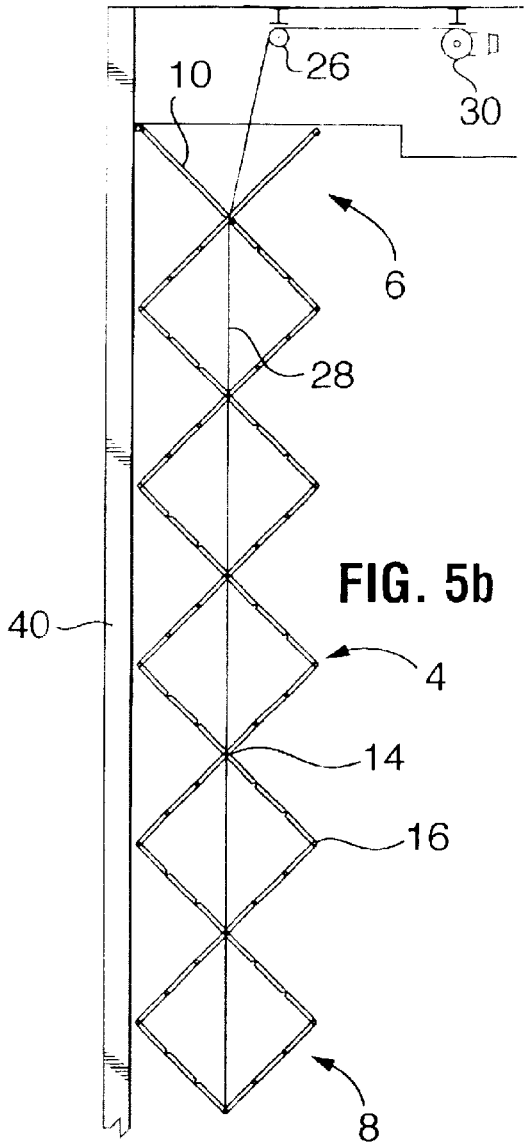
Figure 5C:
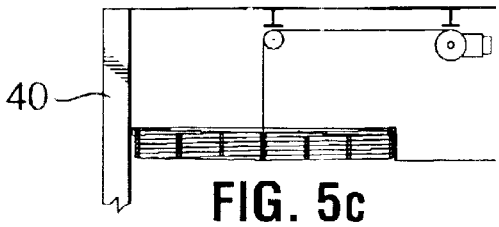

FIGS. 5*a*, 5*b* and 5*c* are schematic side elevation views of an alternative embodiment of curtain 2 in accordance with the present invention. In this case, the trains 4 are pivotally secured to a wall or other support 40 at the upper ends 42 of the upper most elongated members 10 as illustrated. In this manner, as drums 30 wind up cables 28 over their corresponding sheaves 26, from closed position (FIG. 5*a*) to open position (FIG. 5*c*), the centre line of trains 4 along the longitudinal apexes 14 progressively moves away from support 40 until, when the curtain is in open position as illustrated in FIG. 5*c*, those longitudinal apexes 14 have moved their maximum distance away from support 40 and are preferably positioned below sheaves 26.

Figure 6:
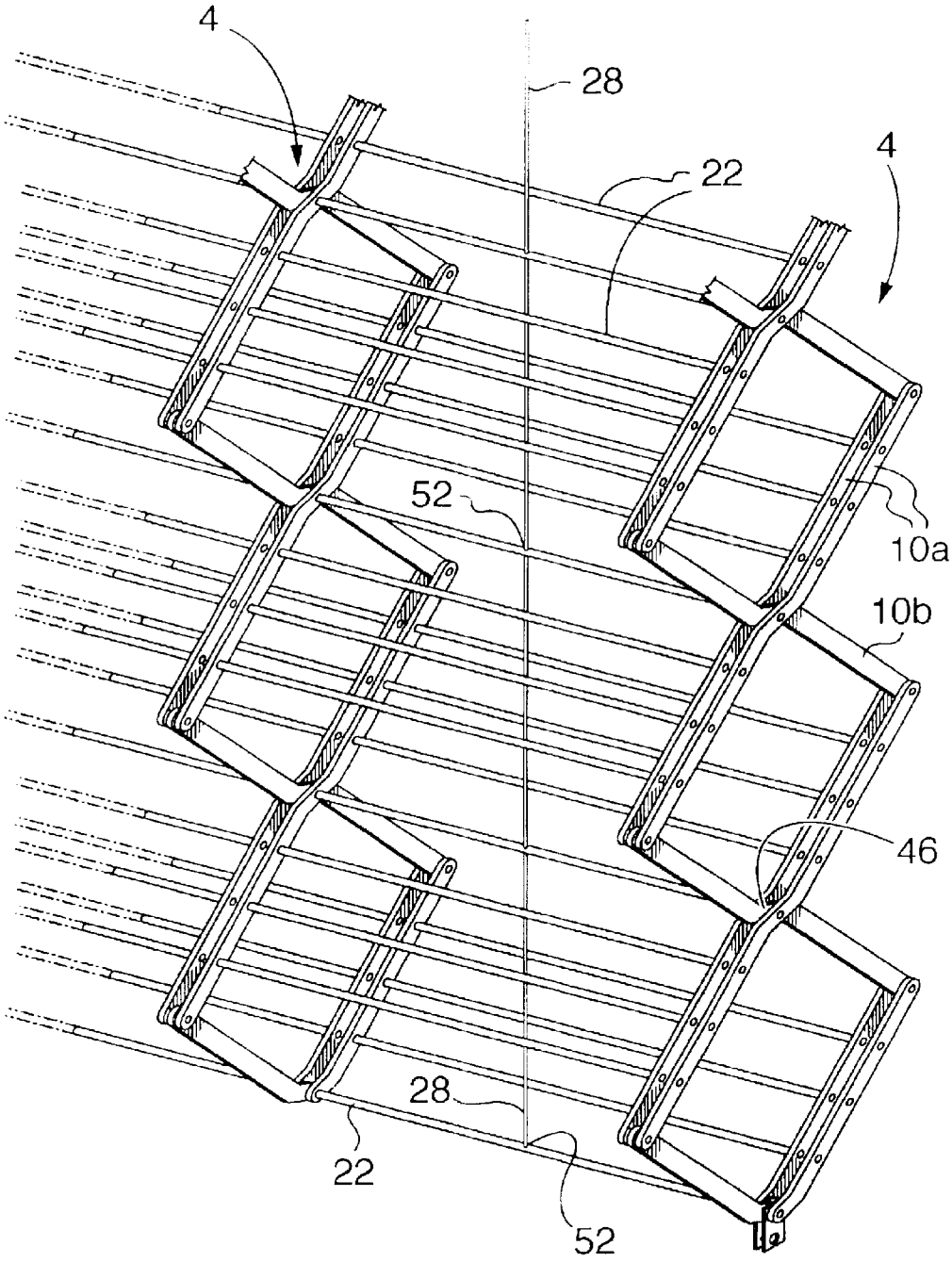
FIG. 6 is a perspective view of an alternative train construction for a mechanical curtain according to the present invention.
Figure 7:
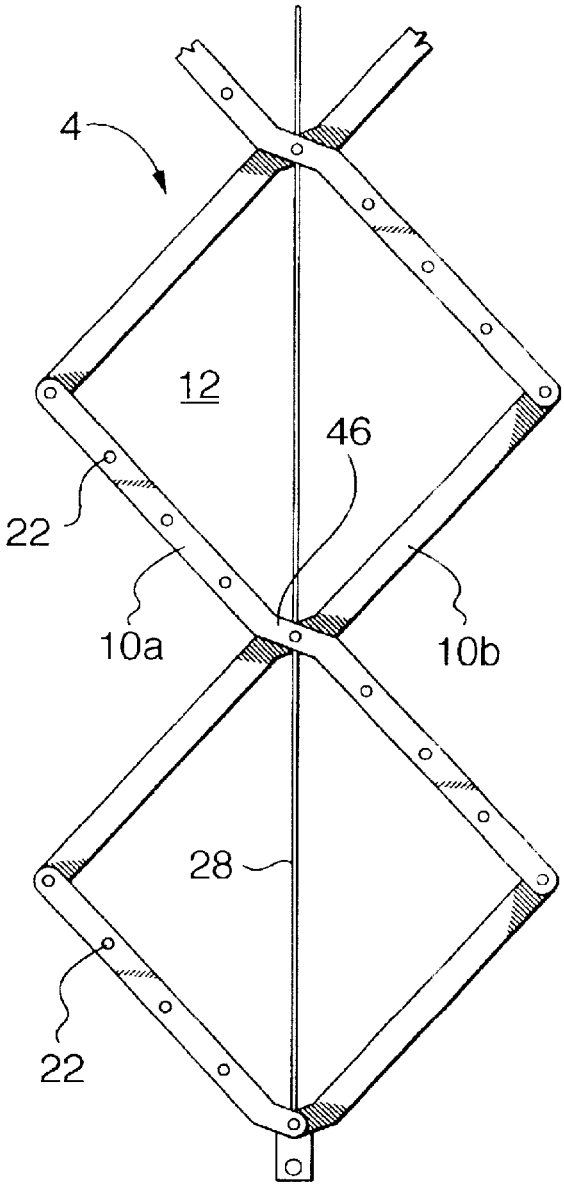
FIG. 7 is an enlarged side elevation view of a portion of the train of FIG. 6 in partially closed position showing in more detail certain of the components of the train.
Figure 8:
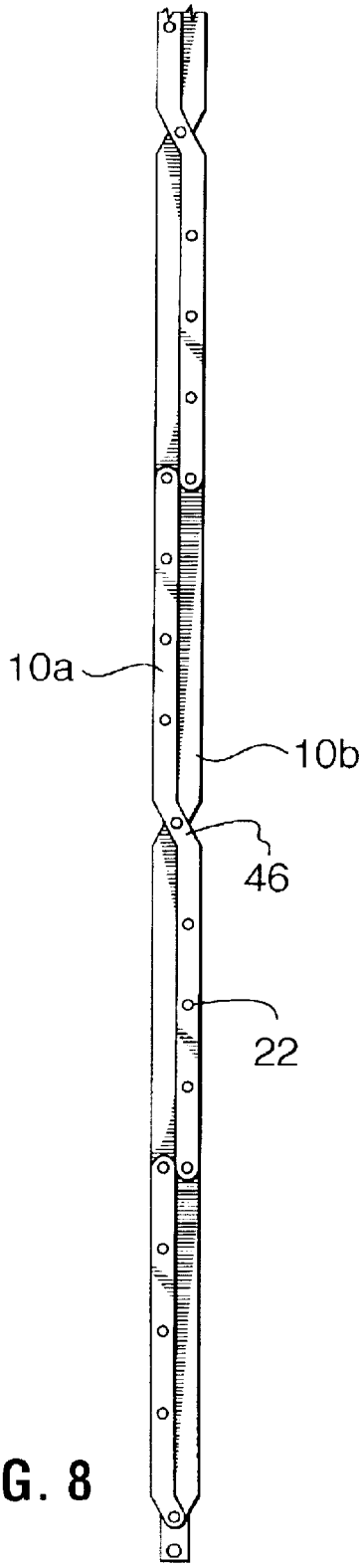
FIG. 8 is a side elevation view of the train of FIG. 7 in fully expanded (or closed) position.
Figure 9:
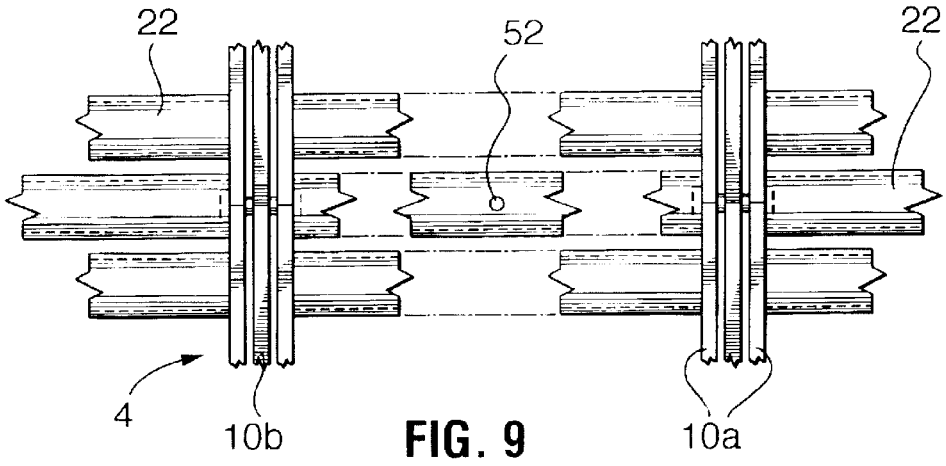
FIG. 9 is a plan view from the top of a portion of the curtain according to the present invention incorporating the construction of FIG. 7.

Turning to FIGS. 6, 7 and 8, there is illustrated an alternative construction of curtain 2 in which each elongated member 10 of train 4 is provided with a jog 46 as illustrated. Opposite ends of 48 and 50 of these members, on either side of jog 36, are parallel. As can be seen in FIGS. 7 and 9, pairs 10*a* of such members 10, on which bars 22 outwardly extend in opposite directions, the members being similarly oriented and positioned, are spaced beside each other and make up one opposing pair of sides of diamonds 12, while similar elongated single members 10*b*, to which no bars 22 are secured make up the other opposing sides. These members 10*b* are sandwiched between members 10*a* at the apexes where they are connected, and are reversed in their orientation with respect to members 10*a*. When the curtain is in elongated, closed orientation, (FIG. 8) this construction permits the bars to be in vertical orientation, albeit, again for reasons of balance, staggered on opposite sides of the longitudinal axis of the curtain trains 4 as illustrated. (The embodiment of curtain illustrated in FIGS. 1 to 5, prevents the bars from being in vertical alignment.) The embodiment of train construction illustrated in FIGS. 6 to 8 requires inner members 10*b* to have no bars secured to them so that the bars secured to members 10*a* of a particular diamond 12 will not bear against cooperating, opposed members 10*b* in that diamond during the contraction of the trains.

In this embodiment, cables 28 are illustrated as passing through apertures 52 centered in the lowest bars 22 extending between longitudinal apexes 14 of trains 4.

Figure 10:
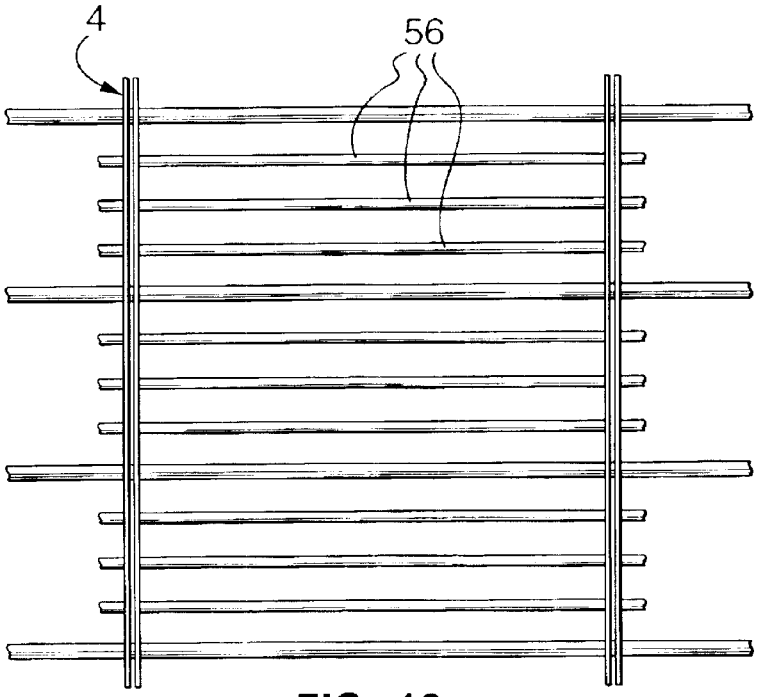
FIG. 10 is a partial front elevation view showing details of an alternative embodiment of the curtain of the present invention.
Figure 11:
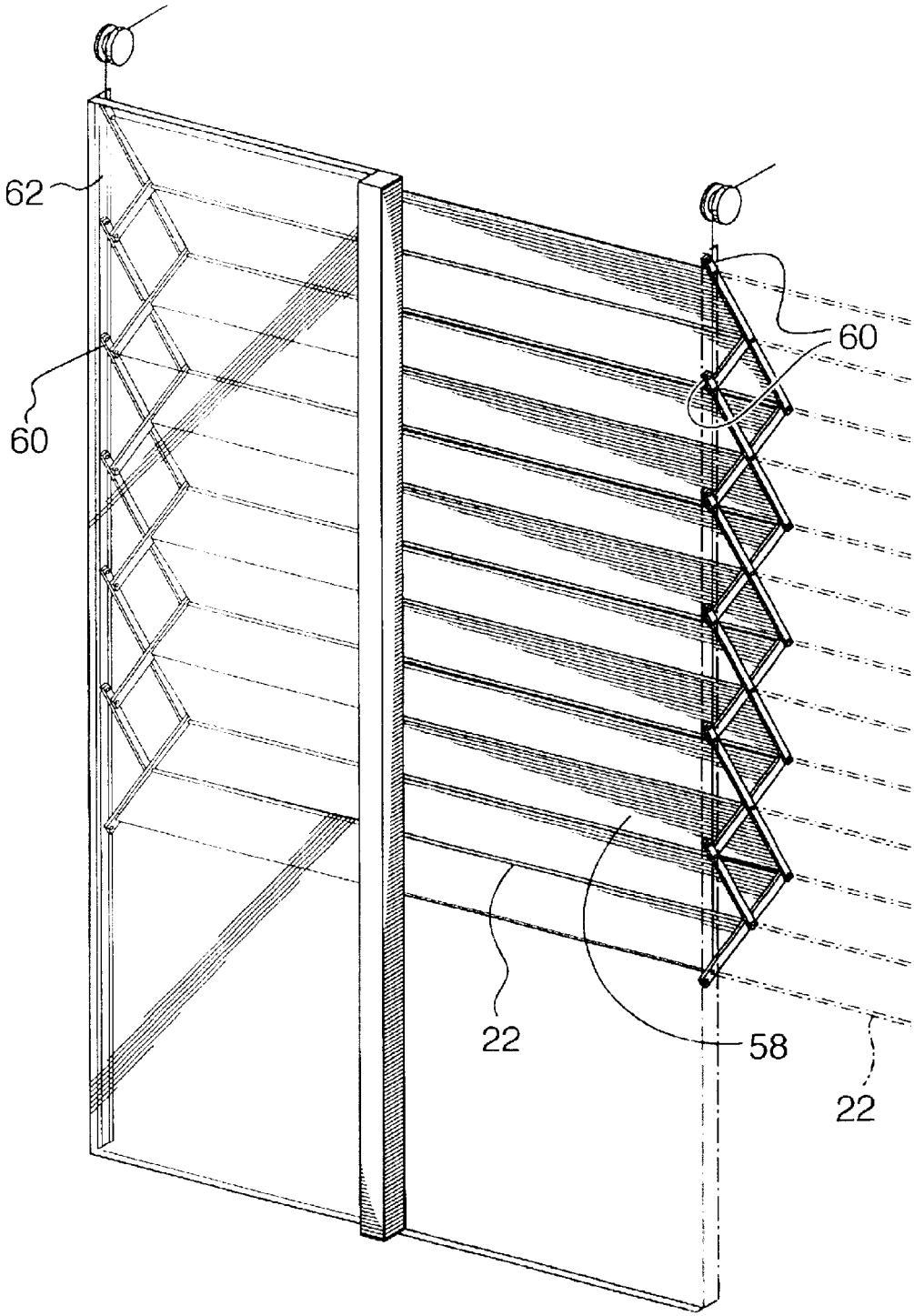
FIG. 11 is a perspective view of yet a further alternative embodiment of curtain according to the present invention in partially closed position.

In FIG. 10, additional horizontally disposed subsets of bars 56 may be provided as required, extending between trains 4, for aesthetic or functional purposes In the embodiment illustrated in FIG. 11, a similar extension 60 is laterally disposed in the plane of each diamond 12, from each laterally disposed apex 16. The end of each extension 60 is secured by appropriate conventional means to slide up and down within a corresponding track 62. In this embodiment, cables 28 lie along one edge of each pantograph train 4, as illustrated, and are secured at its free end to their lowest extension 52. Track 62 may be supported by existing structures such as walls or posts, or may be free standing.

As illustrated in FIG. 11, a fabric 25 may also be fitted over bars 22 as desired, for purposes such as decoration, obscuring or preventing visibility through the curtain, or other functions. This fabric may for instance be a type of Kevlar (trademark) cloth which is bullet proof or may be solar type cloth which has solar heat control or energy creation applications (i.e. which is made of solar cell material that can convert light energy into electrical energy).

Figure 12:
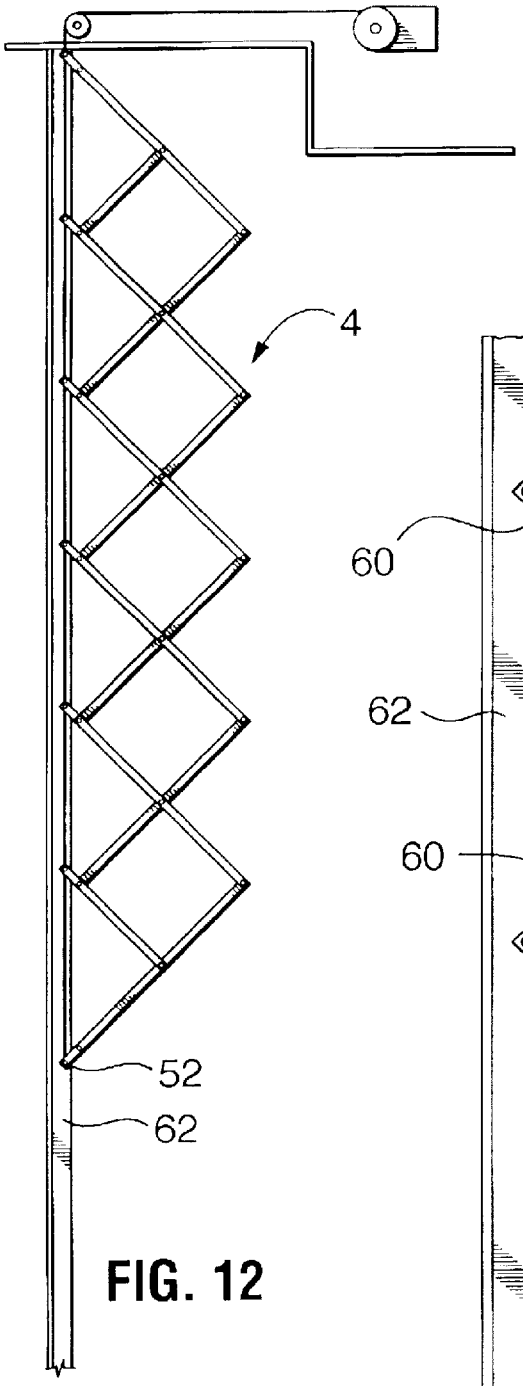
FIG. 12 is a schematic side elevation view of the curtain of FIG. 12 without fabric.
Figure 13:
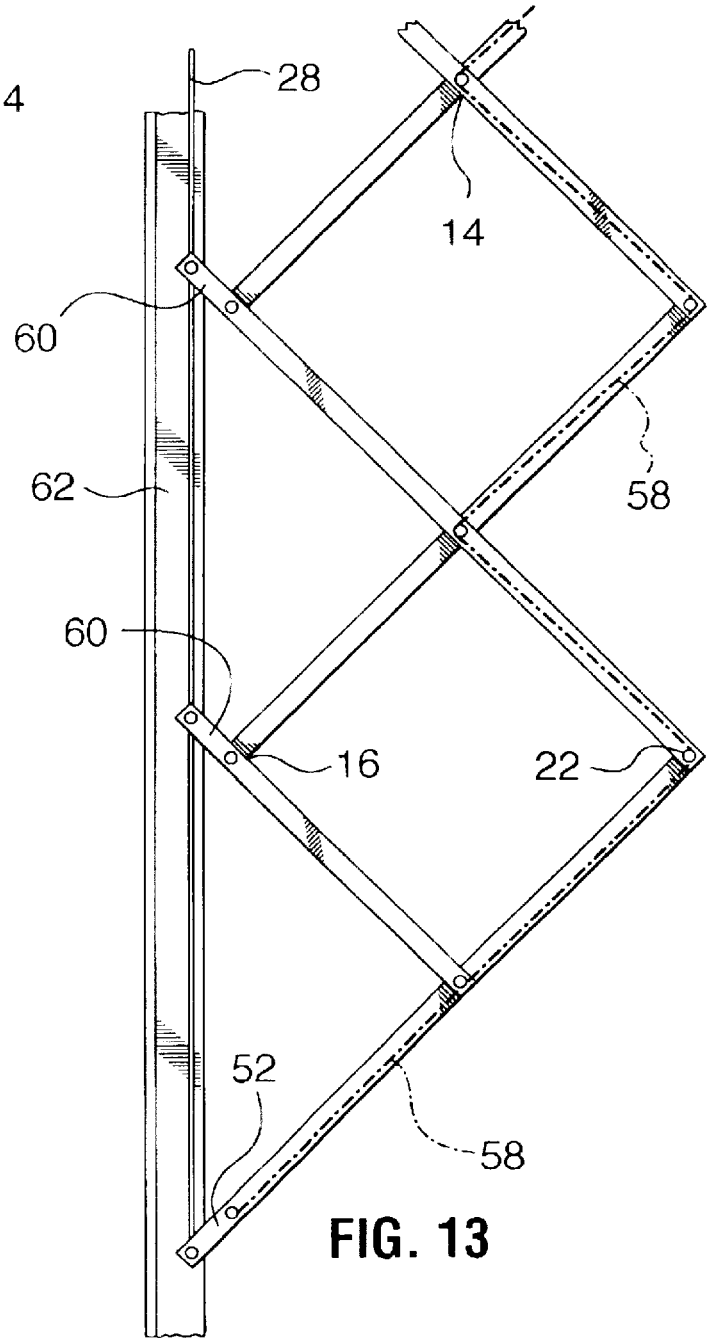
FIG. 13 is a schematic side elevation view of a portion of the curtain of FIG. 12, with fabric.

In FIG. 12, an arrangement of curtain, similar to that of FIG. 11 but without any fabric on it, is illustrated in side elevation view, at a position in mid travel between its open and closed positions. In FIG. 13, a more detailed view, again from a side elevation perspective, of the curtain of FIG. 11 is illustrated, on which fabric 58 is illustrated.

The mechanical curtain of the present invention, whether used for security, solar control or otherwise, is relatively simple to construct and operate, and may readily be made visually appealing, while having all of the above mentioned advantages over prior art security gates and the like.

Thus, it is apparent that there has been provided in accordance with the invention a mechanical curtain that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A mechanical curtain, upwardly movable into open position and downwardly movable into closed position, the curtain comprising:

a) a plurality of similarly constructed trains of elongated members, the members of each train arranged to form a single pantograph forming longitudinally aligned rows of diamonds, the trains spaced laterally to form a curtain plane and oriented so that the diamonds of the pantographs operate in a plane at a 90° angle to that curtain plane, b) a plurality of bars secured in parallel spaced fashion to corresponding members in adjacent trains, perpendicular thereto, and, c) means to raise and lower the trains at a similar rate the pantographs being contracted when the curtain is in open position and the pantographs being elongated when the curtain is in closed position.

2. A mechanical curtain according to claim 1, wherein the means to raise and lower the trains comprises a cable means secured to the train, and means to manipulate the cable means so as to simultaneously raise or lower the trains at a similar rate.

3. A curtain according to claim 2, wherein the cable means comprises a plurality of cables, each of the cables secured to a different one of the lower ends of each of the trains, portions of the cables wound about a power driven line shaft so that rotation of the line shaft in one direction, winding up the cables, causes the trains simultaneously and at a similar rate to move to contracted position and rotation of the line shaft in the other direction, unwinding the cables, and causes the trains simultaneously and at a similar rate to move to elongated position.

4. A curtain according to claim 3 wherein similar pairs of elongated members intersect and are secured pivotally together centrally between their ends to form adjoining longitudinally disposed apexes of adjacent diamonds and corresponding ends of these pairs of intersecting members pivotally connect to the ends of similar pairs of intersecting members to form at these ends laterally disposed apexes of the diamonds, so that when the trains are contracted the longitudinal apexes of each diamond are drawn together and the laterally disposed apexes are more separated, and when the trains are elongated the longitudinal apexes of each diamond become more separated and the laterally disposed apexes are drawn together.

5. A curtain according to claim 4 wherein similar pairs of elongated members are laterally offset at the apexes, the cable for each train passing through the corresponding longitudinal apexes between the elongated members.

6. A curtain according to claim 1, wherein notches are provided at appropriate positions in the elongated members of each diamond to receive corresponding portions of bars in cooperating opposite elongated members of that diamond when the curtain is in closed position.

7. A curtain according to claim 1 adapted for use as a security gate, further provided with locking means to secure the curtain in closed position against unwanted opening.

8. A curtain according to claim 1, further provided with elongated lengths of fabric extending between adjacent trains and over a plurality of bars.

9. A curtain according to claim 4, wherein in each train corresponding laterally disposed apexes of the diamonds are provided with similar extensions, the extensions oriented within the plane of the diamond and being slidably secured within a track for expansion and contraction movement of the train.

10. A curtain according to claim 4, wherein in each train similar pairs of elongated members, with their ends extending parallel to each other from a central jog, make up one opposing pair of sides of diamonds while similar single members in reverse orientation make up the other opposing pair of sides of the diamonds, the members of the pairs being spaced from each other and seated about the single members, the longitudinal apexes of the diamonds being centered in the jogs, the bars being secured to extend outwardly from only the pairs of elongated members along the length of the train.

11. A curtain according to claim 4 when the bars are secured on opposite sides of the longitudinal apexes so as to provide a balance of weight on either side of those apexes.

12. A curtain according to claim 10 when the bars are secured on opposite sides of the longitudinal apexes so as to provide a balance of weight on either side of those apexes.

13. A curtain according to claim 8 wherein the fabric extends between all of the bars of the curtain.

14. A curtain according to claim 13 wherein the fabric is of flexible Kevlar (Trademark).

15. A curtain according to claim 13 wherein the fabric is made of solar heat control cloth.

16. A curtain according to claim 13 wherein the fabric is made of solar cell material, which can convert light energy into electrical energy.

* * * * *